United States Patent [19]

Beltrame

[11] Patent Number: 4,612,749

[45] Date of Patent: Sep. 23, 1986

[54] SET OF CONSTRUCTION ELEMENTS

[76] Inventor: Guidalberto Beltrame, 1964 Plan Conthey, Switzerland

[21] Appl. No.: 756,451

[22] Filed: Jul. 18, 1985

[30] Foreign Application Priority Data

Jun. 6, 1985 [CH] Switzerland ..... 2394/85

[51] Int. Cl.[4] ..... E04B 1/02

[52] U.S. Cl. ..... 52/561; 446/127; 52/584; 52/586

[58] Field of Search ..... 52/309, 309.9, 309.11, 52/584, 586, 802, 805, 829, 478, 561, 79.1; 446/111, 112, 122, 124, 127

[56] References Cited

U.S. PATENT DOCUMENTS

| | | | |
|---|---|---|---|
| 2,020,562 | 11/1935 | Miller | 446/127 |
| 3,239,986 | 3/1966 | Russell | 52/584 |
| 3,640,059 | 2/1972 | McKee et al. | 52/586 X |
| 3,724,886 | 4/1973 | Widerby | 52/584 X |
| 4,083,159 | 4/1978 | Hatch et al. | 52/309.1 |
| 4,169,180 | 9/1979 | McDonagh | 52/309.1 |
| 4,251,968 | 2/1981 | Raith et al. | 52/584 |
| 4,413,924 | 11/1983 | Ijima | 52/561 X |
| 4,438,614 | 3/1984 | Raith et al. | 52/802 X |
| 4,531,564 | 7/1985 | Hanna | 52/586 X |

FOREIGN PATENT DOCUMENTS

| | | | |
|---|---|---|---|
| 2203029 | 7/1973 | Fed. Rep. of Germany | 446/127 |
| 603957 | 8/1978 | Switzerland | 52/79.1 |

*Primary Examiner*—Carl D. Friedman
*Assistant Examiner*—Creighton Smith
*Attorney, Agent, or Firm*—Emory L. Groff, Jr.

[57] ABSTRACT

A panel (1) intended to constitute a wall element is formed by two rectangular pieces of sheet metal (2, 3) separated by expanded resin (4). On the periphery of the panel, the connection between the pieces of sheet metal is realized by a shape (6) of synthetic resin. Each piece of sheet metal exhibits along its edges a groove (7), while a groove (6') of the same section is made on the periphery of the panel on its edge faces. Each corner of the panel is formed by a corner piece (8) exhibiting hollows (9, 10, 13, 14) extending the grooves (6', 7') of the panel (1).

8 Claims, 11 Drawing Figures

SET OF CONSTRUCTION ELEMENTS

Swiss Pat. No. 603,957 relates to a set of construction elements making it possible to constitute several walls assembled together, this set comprising plane rectangular panels, each panel exhibiting on each of its main faces a groove going along each of the edges of this face, the four edge faces of this panel also exhibiting a groove oriented in the direction of the length of each of the edge faces, these latter grooves being half-way between the edges of the main faces of the panel, such that hooking elements exhibiting projecting parts may be introduced into the grooves of two contiguous panels to assemble them together.

The present invention has the aim of reducing the number of different pieces that are necessary for the construction of a lodging or a shelter.

According to the invention, this result is obtained thanks to the fact that each groove parallel to an edge of a face of a panel is connected to or communicates with, the corresponding groove, located on the other face, by two grooves going through two edge faces.

The accompanying drawing shows diagrammatically and by way of example an embodiment of the various elements of a set which is the object of the invention.

Figure 1:
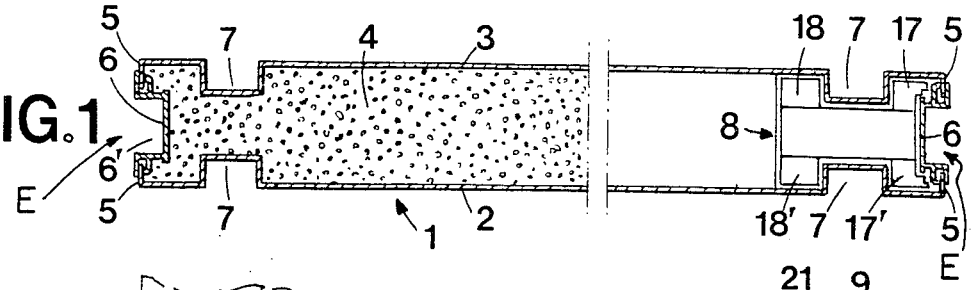
FIG. 1 is a cross section of a panel.
Figure 5:
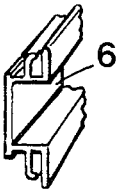
FIG. 5 shows a part of a constitutive element of a panel.

With reference to FIG. 1, panel 1 is formed by two pieces of sheet metal 2 and 3 of general rectangular shape and constituting the main faces of the panel. A mass 4 of synthetic resin foam is sandwiched between the two pieces of sheet metal 2 and 3. The edges of each of these pieces of sheet metal exhibit an edge portion 5 bent in the direction of the opposite piece of sheet metal. The bent portions 5 of these pieces of sheet metal which are opposed one another are connected together by a synthetic resin connecting piece 6, a portion of piece 6 being shown on a larger scale in FIG. 5. This piece 6 is trough-shaped and its hollow portion constitutes a groove 6' oriented in the direction of the length in each of the panel edge faces E, this groove 6' being half-way between the edges of the adjacent main faces of the panel.

Each panel 1 exhibits on each of its main faces a groove 7 going along and parallel each of the edges of this face. These grooves 7 are obtained by deformation of each of pieces of sheet metal 2 and 3, a deformation made before the panel is finished.

Figure 2:
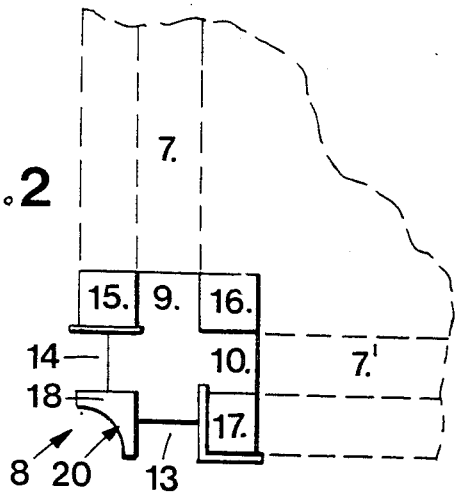
FIGS. 2 to 4 show more in detail a corner piece of a panel.

FIG. 2 shows a corner of a panel 1, this latter being shown in broken lines to show better corner piece 8 constituting this corner. It should be noted that a groove 7 of the panel communicates with or intersects a groove 7' of this same panel oriented at a right angle to the first. Corner piece 8 is in a general cubic shape with hollow portions 9 and 10 extending grooves 7 and 7' of a main face. Of course, opposite to hollow portion 9 is a hollow portion 9' which extends groove 7 of the opposite face of panel 1.

Figure 3:
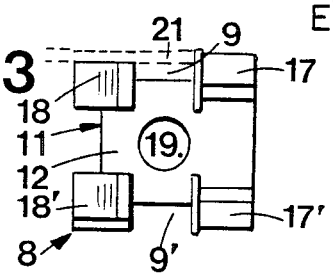

As FIG. 3 shows, corner piece 8 also exhibits hollow portions 11 and 12, which constitute the end part of the two grooves 6' of the edge faces E that end at the angle considered.

Thanks to hollow portions 9 and 10, groove 7, or 7', of a face of the panel is connected to the corresponding groove, located on the other face, by a groove 13, or 14, going through the two edge faces of the panel.

Figure 4:
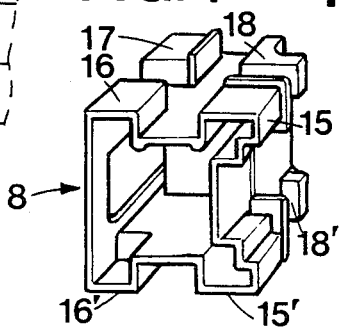

Hollow parts 9, 10, 11 and 12, made in the general cubic shape of corner piece 8, cause to appear, on this latter, projecting parts 15, 16, 17 and 18 on the face that can be seen in FIG. 2, and corresponding projecting parts 15', 16', 17' and 18' of which three can be seen in FIG. 4.

These projecting parts assure guiding of pieces of sheet metal 2 and 3 in relation to one another, coming to engage in the space between bent portion 5 of these pieces of sheet metal and the outside lateral edge of groove 7, going along this bent portion. This arrangement has been shown diagrammatically on the right part of FIG. 1, where it is also noted that projecting parts 18 and 18' come to rest against the other lateral edge of grooves 7. When the four corner pieces 8 are placed at the four corners of the panel, an excellent positioning of the two pieces of sheet metal in relation to one another is obtained, in regard to their spacing and their superposition.

As FIG. 4 shows, corner piece 8 is hollowed to be able to be filled by the resin foam 4 which separates pieces of sheet metal 2 and 3. FIG. 3 also shows that at least one corner piece per panel exhibits a hole 19 which makes it possible to inject resin inside the panel when it is formed by the two pieces of sheet metal 2 and 3 assembled by the four corner pieces. The injected resin with a honeycomb structure is selected from those that strongly adhere to the sheet metal or coating provided on it, so that after injection of the resin, the assembly of pieces of sheet metal 2 and 3 and the four corner pieces constitute a rigid block that can no longer be disassembled.

It should be pointed out that, with the exception of the corners of the panels where pieces of sheet metal 2 and 3 are in contact with the corner pieces, which normally are of injected cast aluminum, these pieces of sheet metal are always separated from one another by synthetic resin 4 and by synthetic resin pieces 6 both of which are poor heat conductors. The resulting panel thus exhibits an excellent insulating power from the calorific viewpoint.

It should be noted that projections 18 and 18', which make the connection between the edge faces of the panel, exhibit a reverse quarter-round cylindrical surface 20, so that when four panels are juxtaposed in the same plane, a circular cylindrical free passage is made at the junction point of the four corner pieces of these panels. This free passage allows the passage of a bolt intended to connect two plates 21, shown in broken lines in FIG. 3, and intended to hold the four corner pieces together. To allow an excellent fastening, plates 21 can be combined with a cylindrical central stud engaging in said free passage and also with projections engaging in hollows 9 and 10, or 9' and 10', of the four corner pieces. It should be noted, as can be seen well in FIG. 3, that projections 18 and 18' are lower than neighboring projecting parts 15, 16 and 17, by the value of the thickness of plates 21. In this way, the outside surface of plates 21 come in the extension of the main faces of the panel.

Figure 6:
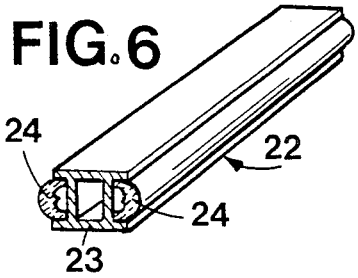
FIG. 6 shows a hooking element in perspective with partial section.

FIG. 6 shows a part of a hooking element 22 which is intended to be engaged between grooves 6', 7 or 7' of two panels to be assembled together. This hooking element 22 is in the shape of a bar of approximately rectangular section and is constituted by a shape 23, hollowed in section in the form of a II. In this way, on each of its large faces, shape 23 exhibits a hollow in which is engaged an elastomer strip 24, which also goes over the end surfaces of this bar. During locking of two panels against one another, by means that will be described below, element 22, engaged in the grooves, assures the fluid tightness of the connection between the panels thanks to the elastic support exerted by strip 24. Elements 22 have lengths making it possible to fill grooves 7 and 7', respectively, either with a single element or several elements put end to end.

Figure 7:
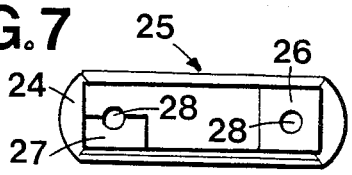
FIGS. 7 and 8 show a second hooking element.
Figure 8:
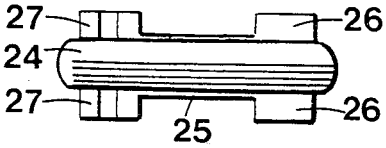

FIGS. 7 and 8 show another hooking element 25 which also exhibits an elastomer fitting on two of its longest faces and on its two end faces. Further, at each of its large faces not having the elastomer, it exhibits a projection 26, or 27, whose section corresponds approximately to the free section of a groove 7 for projection 27 and two juxtaposed grooves for projection 26. The distance separating projections 26 from projections 27 corresponds to that separating two hollow portions 9 or 10 from two juxtaposed corner pieces 8. These hooking elements 25 particularly make it possible to hold two corner pieces 8 against one another. Close to each of its ends, hooking element 25 exhibits a bore 28 allowing the passage of a fastening screw, if desired.

Figure 9:
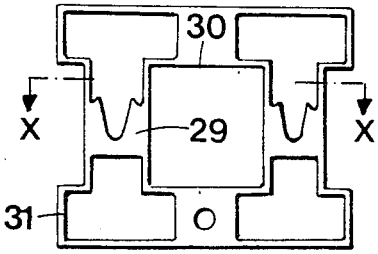
FIGS. 9 and 10 show a third hooking element in front view and in section, respectively.
Figure 10:
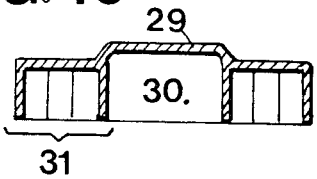

FIGS. 9 and 10 show, respectively, in plane view and section along line XX of FIG. 9, a hooking element which is made up of a plate 29 whose one face exhibits a hollow 30 whose shape allows it to be engaged on two or four of projections 15 to 18 of several juxtaposed corner pieces. The same face of plate 29 also exhibits projecting parts 31 exhibiting a section allowing their engagement in a part of grooves 7 or 7'.

Figure 11:
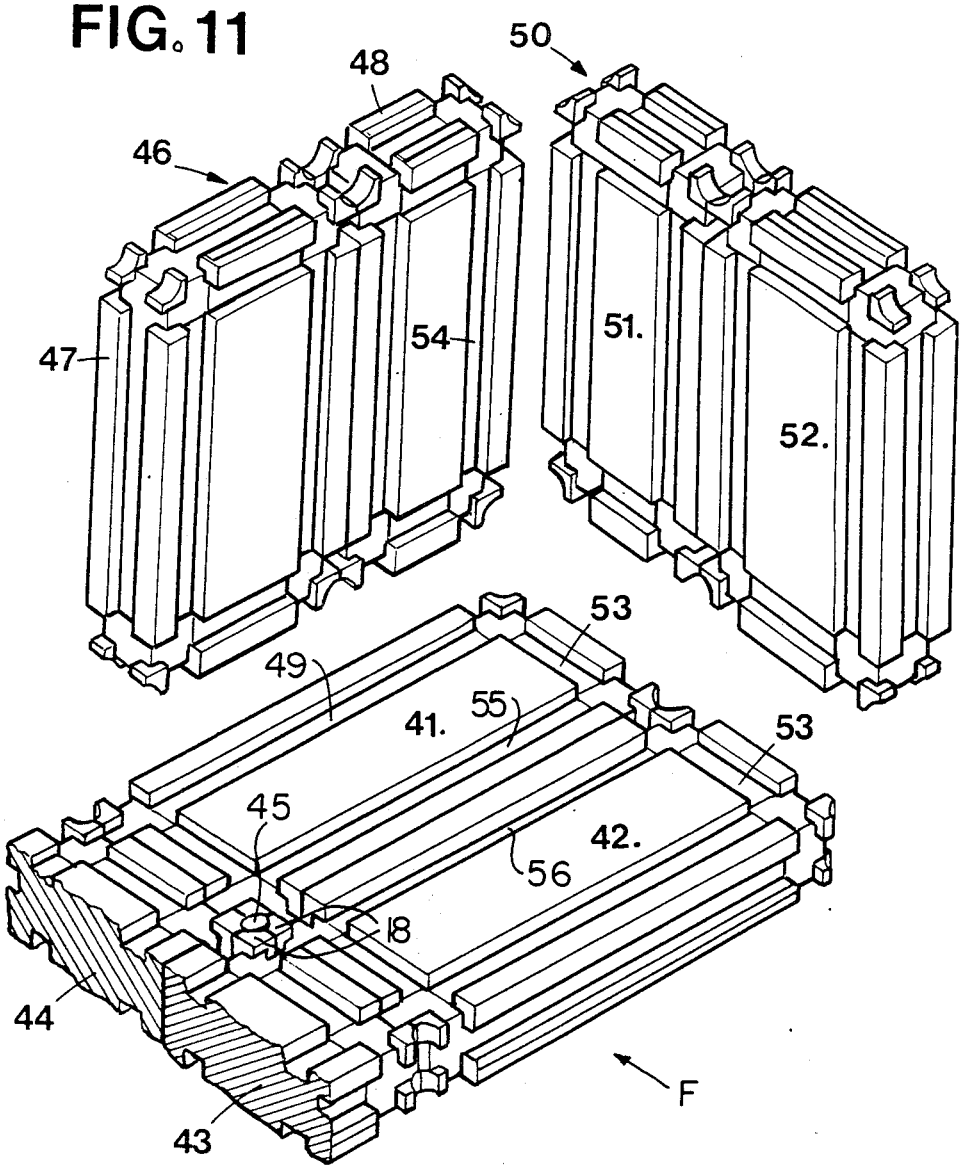
FIG. 11 shows in perspective a panel arrangement making it possible to form a floor and two lateral walls.

FIG. 11 shows the way of assembling several panels 1 to constitute a lodging. Four panels 41, 42, 43 and 44 are juxtaposed and are held together by plates (not shown) locked by a screw going through cylindrical passage 45 which is obtained by juxtaposition of quarter-round projecting parts 18, of four corner pieces of said panels. Of course, hooking elements 22 are to be engaged in the grooves of the edge faces of these panels which are opposite one another and which thus assure fluid tightness of the joint. It is clear that, depending on the dimensions of the lodging to be created, it will be possible to assemble for the floor F a number of panels 1 greater than that illustrated in the drawing. A wall section 46 is formed by two panels 47 and 48 which are placed perpendicular on the floor, with insertion of hooking elements 22 between the grooves of the lower edge faces of panels 47 and 48 and a groove 49 of panel 41 of the floor. Another wall section 50 is formed by two panels 51 and 52, also placed perpendicular on the floor and adapted to be guided in relation to it by a hooking element 22 engaged in a groove 53 of this floor, while the two wall sections 46 and 50 are engaged with one another, always by a hooking element 22 introduced into the groove of the edge face of panel 51 and in groove 54 of panel 48.

The section of hooking elements 22 in the state of rest is greater than the free section of two juxtaposed grooves, so that it is necessary to exert a rather great force to lock the two grooves against one another to crush the elastomer fitting of hooking elements 22. To exert this locking force, it suffices to provide relatively simple tools, of the type of a vice or again of locking pliers whose jaws are introduced into two grooves of two neighboring panels, for example, grooves 55 and 56 of panels 41 and 42. During this locking, hooking elements 25 and/or 29 are put in place, then the locking elements are unlocked, the hooking elements remaining in place under the effect of the elastic thrust exerted by the elastomer fittings. Of course, it is advantageous to fix in a final way the position of the hooking elements with a screw and/or bolts.

It should be noted that in FIG. 11, for the convenience of the drawing, the panels were represented much smaller and much thicker than they really are. As a rule, to construct a dwelling, panels will be used which exhibit a width on the order of 1 meter and a length of more than 2 meters, while their thickness will be on the order of 6 to 8 cm.

I claim:

1. Set of construction elements making it possible to constitute several walls assembled together, this set comprising plane rectangular panels, each panel having two main faces each provided with a groove extending adjacent and parallel to each of four edges on said face, four edge faces on said panel each having a groove oriented in the direction of the length of each of the edge faces, these latter grooves being half-way between said edges of the main faces of the panel, hooking elements having projections intended to be introduced in selected ones of said grooves of two contiguous ones of said panels to assemble them together, characterized in that each said groove parallel to an edge of a face of a panel is connected to the corresponding groove located on the other face by two grooves going through two said edge faces and the ends of two adjacent ones of said edge faces are connected together by reverse quarter-round cylindrical surfaces, to form a circular cylindrical free passage between four of said panels juxtaposed in the same plane.

2. Set according to claim 1 wherein the four corners of a panel are constituted by initially separate corner pieces of a general cubic form, fastened to the panel, each corner piece having hollow portions constituting the ends of two said grooves of each main face, and said two latter grooves going through said edge faces are formed in each said corner piece.

3. Set according to claim 2, wherein each panel is formed by two pieces of sheet metal constituting said main faces and between which a mass of synthetic resin foam is sandwiched, said main face edge of each sheet metal piece comprising a portion bent in the direction of and opposed the other said sheet metal piece, said pairs of said opposed bent portions of the two sheet metal pieces each being connected together by a synthetic resin piece, in the shape of a trough to constitute said grooves in said edge faces.

4. Set according to claim 3, wherein each said corner piece includes projecting parts, each being intended to be engaged between one said bent portion of one said sheet metal piece and an outside lateral edge of said main face groove disposed adjacent this said bent portion.

5. Set according to claim 4, wherein said corner pieces are hollowed to be able to be filled with said resin foam, at least one of said corner pieces including a hole allowing the injection of said resin foam inside the panel when it is formed by the assembly of said two pieces of sheet metal with said four corner pieces.

6. Set according to claims 1 to 2, wherein said hooking elements are in the shape of a bar with an approximately rectangular section, said bar being covered by an elastomer on two of its opposite large faces and on two of its end faces.

7. Set according to claim 6, wherein said bars exhibit at each end of their faces not having elastomer a projection directed perpendicularly to the plane of the face considered and whose section corresponds approximately to the free section of one or two said main face grooves.

8. Set according to claim 7, wherein said corner pieces include a plurality of projecting parts formed by crossing of two said main face grooves, said hooking elements comprising a plate having one face exhibiting a hollow whose shape is engageable with at least two of said corner piece projecting parts, said hooking element plate face having projecting parts adjacent said hollow, said latter projecting parts exhibiting a section allowing their engagement in a part of said main face grooves of the panels.

* * * * *